US006779566B2

(12) United States Patent
Engel

(10) Patent No.: US 6,779,566 B2
(45) Date of Patent: Aug. 24, 2004

(54) CONNECTOR DEVICE FOR SEALING AND DISPENSING FREEZE-DRIED PREPARATIONS

(75) Inventor: Steven P. Engel, Rockford, MI (US)

(73) Assignee: Access Business Group International LLC, Ada, MI (US)

( * ) Notice: Subject to any disclaimer, the term of this patent is extended or adjusted under 35 U.S.C. 154(b) by 0 days.

(21) Appl. No.: 10/341,976

(22) Filed: Jan. 14, 2003

(65) Prior Publication Data

US 2004/0134562 A1 Jul. 15, 2004

(51) Int. Cl.[7] ..... B65B 3/04

(52) U.S. Cl. ..... 141/25; 141/2; 141/9; 141/18; 141/100; 141/330; 206/229; 206/570

(58) Field of Search ..... 141/2, 9, 18, 21, 141/25–28, 100, 329, 330; 206/223, 229, 570–572

(56) References Cited

U.S. PATENT DOCUMENTS

| | | | | |
|---|---|---|---|---|
| 2,773,521 A | | 12/1956 | Persson | |
| 3,156,272 A | | 11/1964 | Indrunas | |
| 3,592,245 A | | 7/1971 | Devon et al. | |
| 3,857,423 A | | 12/1974 | Ronca, Jr. | |
| 3,874,380 A | * | 4/1975 | Baum | 128/200.14 |
| 4,573,506 A | | 3/1986 | Paoletti | |
| 4,614,437 A | | 9/1986 | Buehler | |
| 5,209,565 A | | 5/1993 | Goncalves | |
| 5,393,497 A | * | 2/1995 | Haber et al. | 422/103 |
| 5,533,553 A | | 7/1996 | Vesborg | |
| 5,641,010 A | | 6/1997 | Maier | |
| 5,740,654 A | | 4/1998 | Manni et al. | |
| 5,909,753 A | | 6/1999 | Rossi et al. | |
| 6,237,649 B1 | | 5/2001 | Moisio et al. | |
| 6,408,897 B1 | * | 6/2002 | Laurent et al. | 141/100 |

* cited by examiner

*Primary Examiner*—J. Casimer Jacyna
(74) *Attorney, Agent, or Firm*—Warner Norcross & Judd

(57) ABSTRACT

A connector device is provided that permits two separately stored ingredients to be mixed in and dispensed from the same container. The connector device includes an attachment mechanism for connecting two containers together to permit combining of separately stored ingredients and another attachment mechanism for connecting a dispenser to the container containing the combined ingredients to permit dispensing of the product directly from that container. In a preferred embodiment, a stopper is included in the neck of the first container, the second container including a device for penetrating the stopper. Also disclosed is a method of intermixing products with the connector device.

20 Claims, 5 Drawing Sheets

CONNECTOR DEVICE FOR SEALING AND DISPENSING FREEZE-DRIED PREPARATIONS

BACKGROUND OF INVENTION

The present invention relates to connecting devices and, more specifically, to connecting devices for facilitating mixing of two separately stored components.

There are many applications where it is desirable to separately store ingredients of a product prior to use. This is especially true with products that will expire or that are most effective after initial mixing, such as cosmetics and hair dyes. Because these products can only be used for a limited time after combining the ingredients, and because in many cases only small amounts of the product are used for each application, people are often discouraged from purchasing the products in bulk. Additionally, manufacturers must limit the amount of the products that they produce to ensure the products are sold before they perish or lose efficacy. As a result, products that suffer from these problems are often sold in an unmixed state, with separated ingredients that are combined by the consumer prior to use. For example, cosmetics products are often separated into a freeze-dried powder and a solvent. To facilitate mixture of the ingredients, a variety of assemblies have been developed that permit the ingredients to be combined only when desired for use. Typically, these assemblies include two containers, each holding a separate ingredient, and a connector device that interconnects the two containers in a way that permits combination of the ingredients. The connected device providing the consumer with a clean and easy way to mix the products when the consumer wishes to use the product.

Traditional connector device assemblies generally consist of two vials, one containing a liquid and one containing a solid, and a connector device that facilitates the mixing of the two materials. These assemblies are often used in conjunction with cosmetics, where a freeze-dried powder is included in one vial and a liquid is included in another vial.

Conventional connector devices include a lower portion attached to the first vial containing the solid and an upper threaded portion. To connect the two vials, the second vial containing the liquid is screwed into the upper threaded portion of the connector device. After connecting the two vials, the liquid from the second vial is injected into the first vial and the two materials are mixed. The mixed solution is then drawn back into the second vial. To accomplish this, the second vial is generally a dropper bottle. The mixed solution is then dispensed from the second vial.

One disadvantage to this method is that all of the mixed solution is not drawn back into the first vial. The solution that is left in the first vial after transferring the solution to the second vial is generally unusable, and thus is discarded. This is particularly a problem with expensive solutions, such as cosmetic products. Another disadvantage of this method is that it can be rather difficult, requiring the user to use a pulsing motion to draw the solution back into the second vial. This can make the system difficult to use, particularly for those with limited dexterity.

SUMMARY OF THE INVENTION

The aforementioned problems are overcome by the present invention wherein a connector device is provided that permits two separately stored ingredients to be mixed in and dispensed from the same container. The connector device includes an attachment mechanism for connecting two containers together to permit combining of separately stored ingredients and another attachment mechanism for connecting a dispenser to the container containing the combined ingredients to permit dispensing of the product directly from that container.

In a preferred embodiment, the attachment mechanisms include internal threads to attach the connector device to the first container, a guide to shepherd the second container into an appropriate position with respect to the first container to permit its contents to be dispensed into the first container and external threads to attach a dispenser to the first container to dispense the mixed solution.

In a preferred embodiment, the connector device is designed to mount to the top of the first container, which contains a solid such as a cosmetic powder. A stopper is present in the neck of the first container and has an orifice through the center. A perforable membrane covers the orifice and is clamped between the connector device and the stopper. The second container is preferably a syringe containing a liquid. The syringe is used to inject the liquid into the first container. A dispensing pump is attachable to the connector device while the connector device is attached to the first container. The dispensing pump permits the combined ingredients to be easily dispensed from the first container.

In a preferred embodiment, the connector device includes a top portion (e.g. circumferential wall) that is shaped to define a syringe guide that accepts the syringe. The syringe guide shepherds the second container into the correct position through the stopper to dispense the contents of the second container into the first container In a more preferred embodiment, the connecting device has internal threads for attachment of the connector device to the first container and external threads for connection of a dispenser to the connecting device. The external threads preferably wrap around the external surface of the top portion of the connector device.

In a further preferred embodiment, the stopper includes a central orifice covered by a perforable membrane. The perforable membrane covers the top of the stopper, including the central orifice. The diameter of the central orifice is large enough to allow insertion of the tank of the dispenser through the orifice.

The present invention also provides a method for intermixing products including the general steps of: (a) connecting a connector device to a first container containing a first ingredient; (b) connecting a second container containing a second ingredient to the first container by the connecting device; (c) dispensing the ingredients from the second container into the first container to mix the ingredients; and (d) connecting a dispenser to the first container by the connecting device.

In a preferred embodiment, the method more specifically includes the steps of (a) connecting the connector device to a first container having a stopper and a membrane; (b) inserting a dispensing device of the second container into the connector device so that the dispensing device ruptures the membrane and penetrates the stopper; (c) dispensing the second ingredient from the second container into the first container; (d) mixing the ingredients in the first container; and (e) connecting a dispensing pump to the connector device with the dispensing pump tank extending through the stopper to allow the mixture to be dispensed from the first container.

This invention provides a simple and inexpensive connector device that allows a mixture of two or more separately stored ingredients to be mixed and dispensed from the same container. Because the mixture does not need to be drawn back into the second container (e.g., the syringe), the user does not need to manipulate the second vial to draw the mixture out. Additionally, no product is wasted because of failure to draw it back into the second dispensing vial. The use of a syringe as the second container provides a relatively failsafe mechanism for combining the two ingredients. The syringe guide shepherds the syringe end through the stopper in the desired location, thereby addressing concerns of misalignment.

These and other objects, advantages, and features of the invention will be readily understood and appreciated by reference to the detailed description of the preferred embodiment and the drawings.

DETAILED DESCRIPTION OF THE PREFERRED EMBODIMENT

Figure 1:
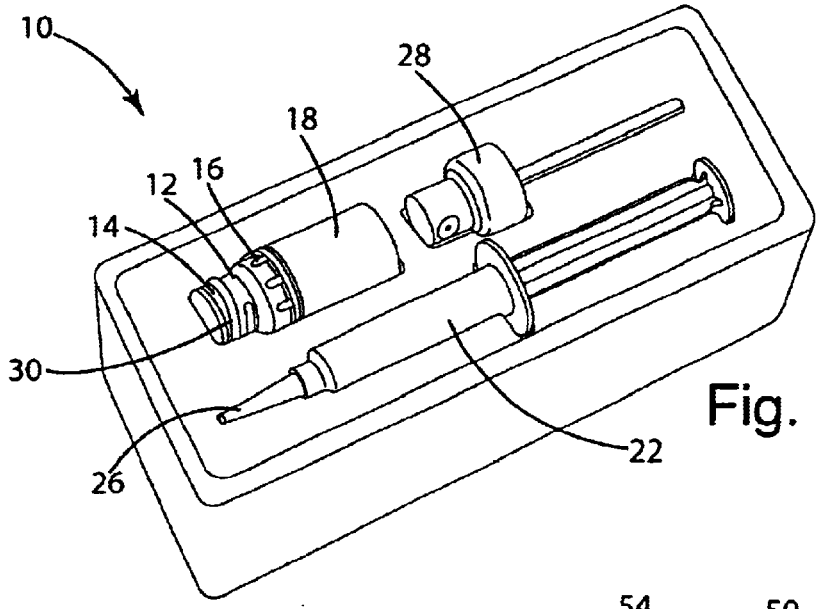
FIG. 1 is a perspective view of a kit for mixing and dispensing a preparation according to a preferred embodiment of the present invention.

A product mixing and dispensing kit 10 incorporating a connector device 12 in accordance with a preferred embodiment of the present invention is shown in FIG. 1. The kit 10 permits two separately stored ingredients to be easily combined and dispensed. In the illustrated embodiment, the kit 10 includes a first container 18, such as a vial, that holds one of the two ingredients 20 (preferably in a powder form) and a second container 22, such as a syringe, that contains the other ingredient 24 (preferably in liquid form). The kit 10 further includes a connector device 12. The connector device 12 is attached to the first container 18 and permits the syringe 22 to be connected to the first container 18 so that the contents of the syringe 22 can be easily injected into the first container 18. The kit 10 also includes a pump dispenser 28. The connector device 12 permits the pump dispenser 28 to be easily attached to the first container 18 to permit dispensing of the combined ingredients. Although the present invention is described in connection with a kit having a vial and a syringe, the present invention is well suited for use with various alternative containers. The terms "mixture" and "combination" are used interchangeably in this application to refer to the resultant of the combination of separate ingredients. These terms are intended to include all types of mixtures, solutions, combinations and other resultants arising out of the combination of the separately stored ingredients.

Figure 4:
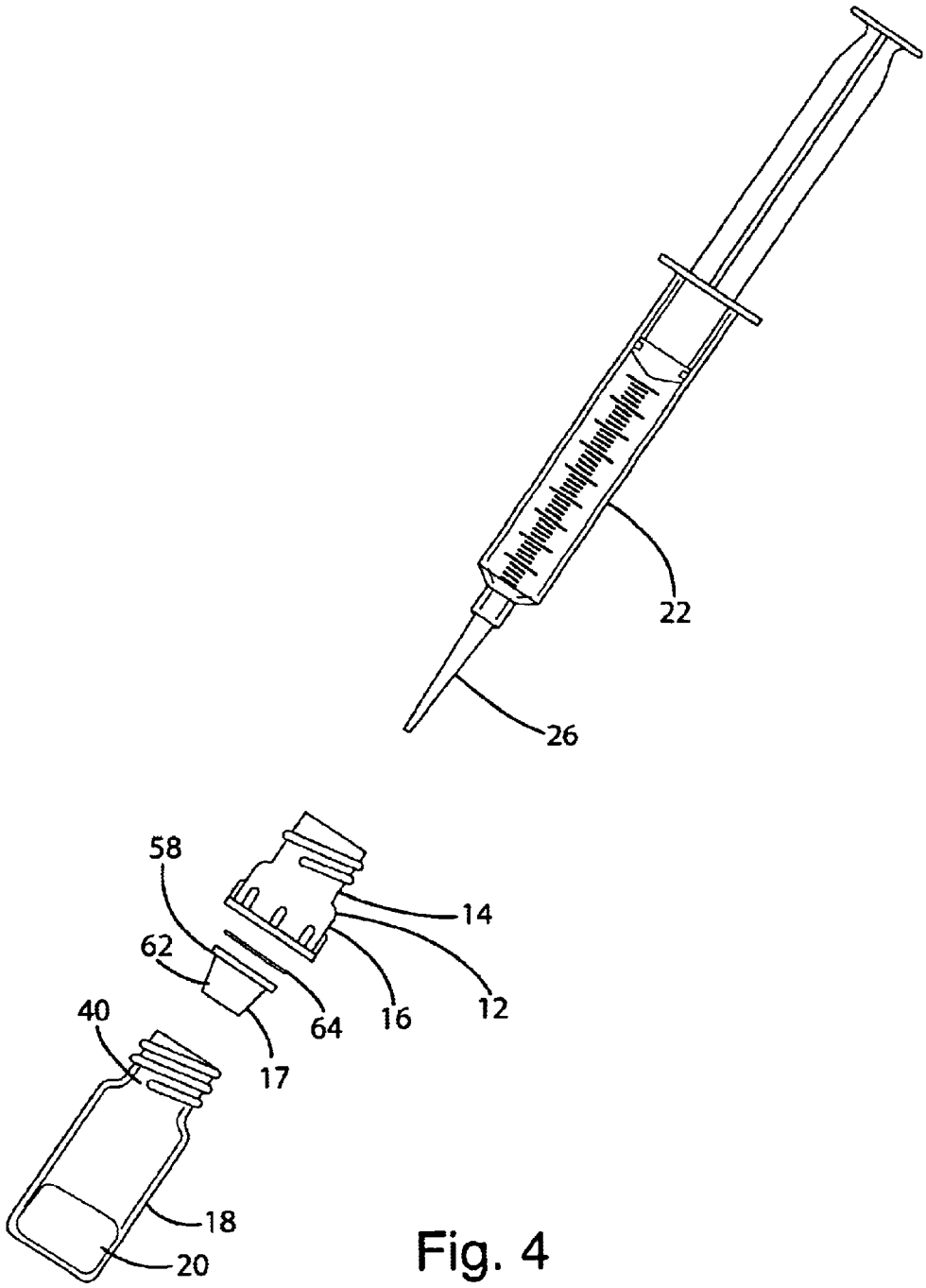
FIG. 4 is an exploded view of a vial and syringe assembly using the connector device.

As noted above, the connector device 12 is connected to a first container 18 containing a first ingredient 20. In the illustrated embodiment, the first container 18 is a conventional glass or plastic vial having a threaded neck that is closed by a stopper 17 (as shown in FIG. 4 and described in more detail below). In the illustrated embodiment, the second container 22 is a conventional syringe that is connectable to the connector device 12. As described in more detail below, the second container 22 has an injection device 26 that penetrates the stopper 17 during use. The second ingredient 24 is dispensed into the first container 18 through injection device 26. In the illustrated embodiment, the dispenser 28 is a generally conventional pump that can be connected to the connector device 12 to dispense the mixture of the first ingredient 20 and the second ingredient 24. In this embodiment, the connector device 12 includes external connectors 30 for connecting the dispenser 28 to the connector device 12. While this invention will be described in relation to an essentially round container and connector device, it is to be understood that both elements can be of essentially any shape, such as rectangular or triangular. Additionally, although the first and second container described in the disclosure will be a vial and a syringe, respectively, essentially any container can be used for either element, such as a bottle or flask.

Figure 2:
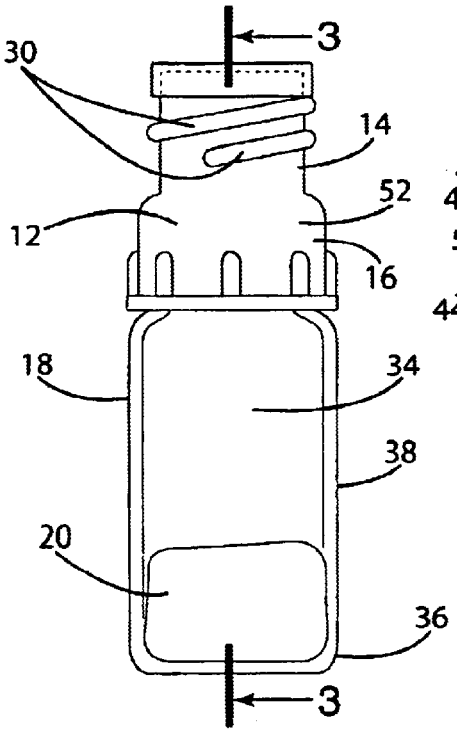
FIG. 2 is a side elevational view of the a vial using the connector device of a preferred embodiment.
Figure 3:
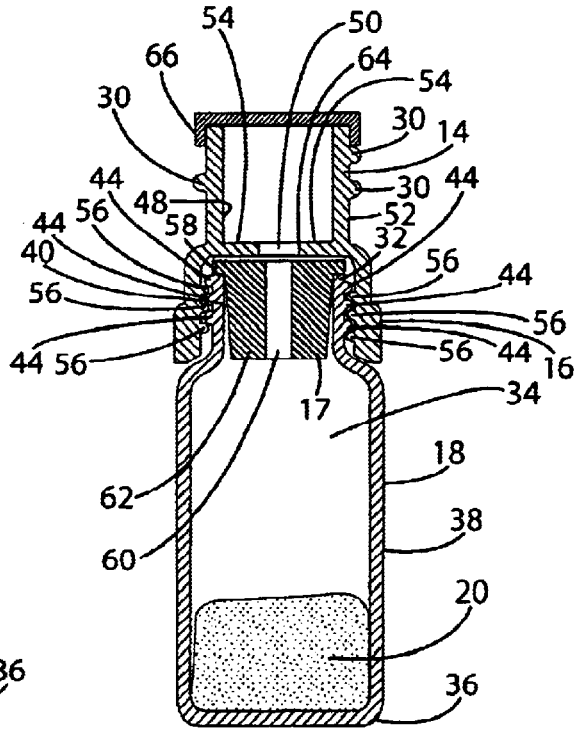
FIG. 3 is a cross-sectional view of the vial and connector device taken along line 3—3.

The kit 10 will now be described in greater detail with reference to FIGS. 2–9. FIGS. 2 and 3 show the connector device 12 attached to first container 18. The first container 18 has a top end 32, a bottom end 36 and an external surface 38 and defines an internal space 34. An open neck 40 is located at the top end 32 of the first container 18. The external surface 38 of the neck 40 includes threads 44, which permit the connector device 12 to be threadedly secured to the first container 18. As an alternative to threads, the first container 18 may include essentially any other type of container connectors capable of connecting the first container 18, such as a snap fitting.

A stopper 17 is fitted with the neck 40 of the first container 18. In the illustrated embodiment, the stopper 17 is manufactured from rubber; however, the stopper 17 can be produced from essentially any material capable of retaining a substance within the first container 18. The stopper 17 has a substantially T-shaped cross section and includes a shelf 58 and a plug 62. The shelf 58 of the stopper 17 rests on the top end 32 of the neck 40. The plug 62 of the stopper is contained within the neck 40 of the first container 18 and seals the first ingredient 20 in the first container 18. The stopper 17 defines a central orifice 60. The central orifice 60 is a hole in the stopper 17 that extends through the stopper 17 from the top end 42 to the bottom end 46 of the stopper 17. The dimensions of the central orifice 60 will preferably depend in part on the size of the dispenser 28 as will be explained further below.

A perforable membrane 64 covers the central orifice 60. The perforable membrane 64 is preferably a generally conventional seal that can be easily pierced by an object, such as a needle or plastic probe. Several materials can be used for this purpose, such as aluminum, tin foil and various laminated materials. The perforable membrane 64 is connected to the shelf 58 of the stopper 17. Any conventional method, such as adhesive, can be used to maintain the perforable membrane 64 in the correct position in relation to the stopper 17.

Figure 5:
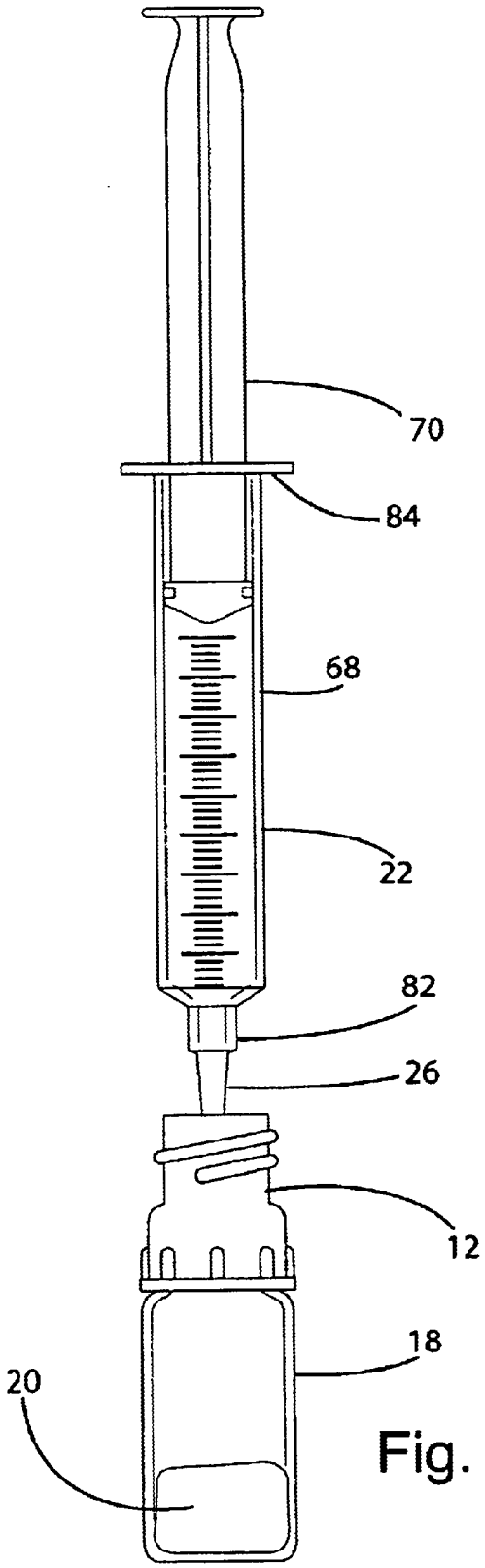
FIG. 5 is a side elevational view of a vial, syringe and connector device assembly according to a preferred embodiment.
Figure 6:
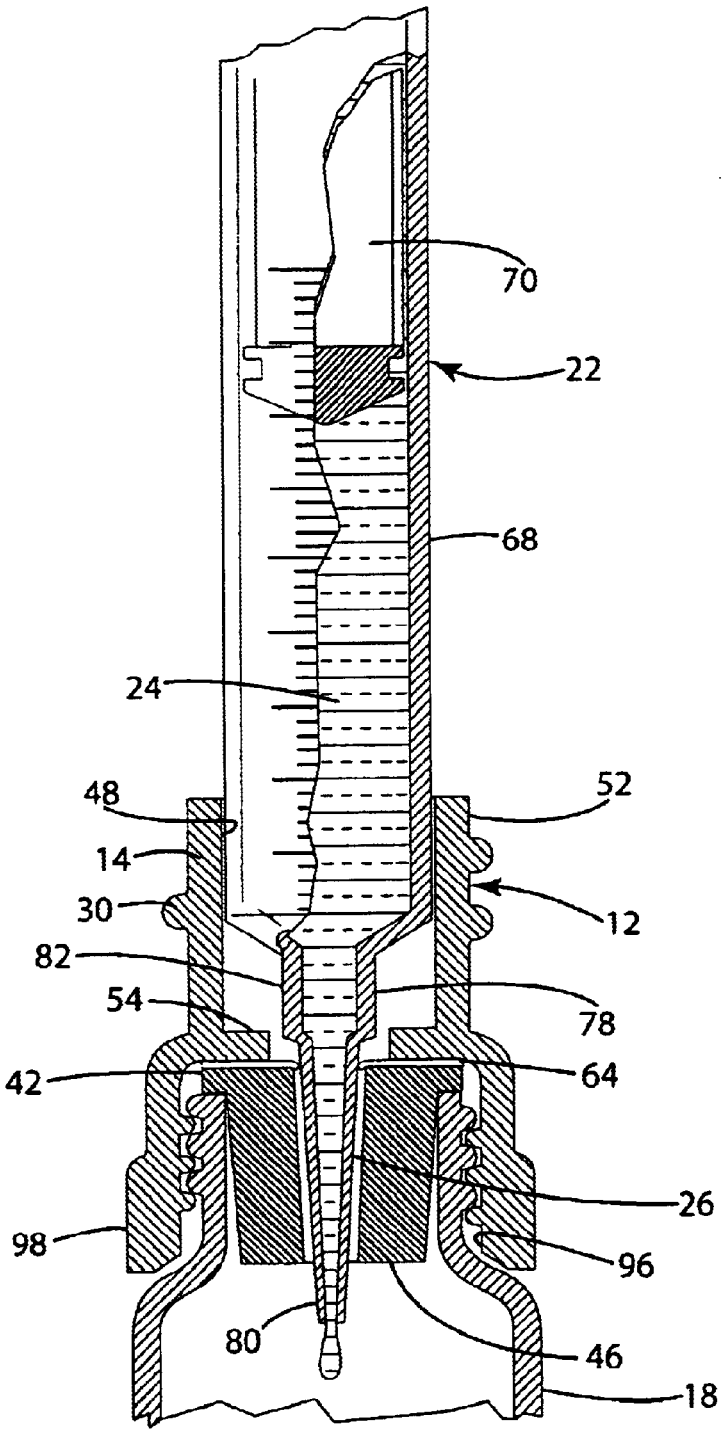
FIG. 6 is a cross-sectional view taken along line 3—3 of the vial, syringe and connector device assembly.

FIGS. 5 and 6 show the interaction of the connector device 12 and the second container 22. The second container 22 can be any container capable of dispensing an ingredient into the first container 18. In the illustrated embodiment, the second container 22 is a syringe having a plunger 70, an injection device 26 and a barrel 68. The injection device 26 is hollow and has an open first end 78 and an open second end 80. The second end 80 of the injection device 26 may include a needle or be pointed to facilitate insertion of the injection device 26 into the stopper 17 through the perforable membrane 64. The barrel 68 is hollow and has an open dispensing end 82 and a back end 84. The first end 78 of the injection device 26 is connected to the dispensing end 82 of the barrel 68 so that a passage exists from the back end 84 of the barrel 68 to the second end 80 of the injection device 26. The barrel 68 contains the second ingredient 24. In the described embodiment, a plunger 70 projects from an open back end 84 of the barrel 68. The plunger 70 is movable from a retracted position to an inserted position to facilitate dispensing of the second ingredient 24. In the retracted position, the plunger 70 is substantially withdrawn from the barrel 68. In the inserted position, the plunger 70 is fully inserted into the barrel 68 so that the plunger 70 contacts the dispensing end 82 of the barrel 68.

The connector device 12 includes an upper portion having a circumferential wall that defines a generally cylindrical guide 14. The top of the guide 14 is preferably sized to interfit with a portion of the second container 22 when the injection device 26 of the second container 22 is inserted into second container 22. More specifically, the internal diameter of the circumferential wall preferably is sized to provide a close fit between the guide 14 and the second container 22 when the second container 22 is in this position. This permits the guide 14 to shepherd the second container 22 into proper alignment with the first container 12. For example, as shown in FIG. 6, the guide 14 may closely receive the barrel 68 of syringe 22. The guide 14 includes an internal surface 48 and an external surface 52. The external surface 52 includes external threads 30. The external threads 30 can alternatively be any connection device capable of connecting the dispenser 28 to the first container 18, such as a snap fitting.

The connector device 12 also includes a lower portion having a circumferential wall that defines a generally cylindrical rim 16. The cylindrical rim 16 has an internal surface 96 and an external surface 98. In the illustrated embodiment, the diameter of the rim 16 is greater than the diameter of the guide 14. The internal surface 96 of the rim 16 includes internal threads 56. The threads 56 can alternatively be replaced by essentiaiiy any connection device capable of interconnecting with the container connectors 44, such as a snap fitting.

The connector device also includes a lip 54 disposed along the junction between the guide 14 and the rim 16. The lip 54 extends inward from the internal surface 48 of the connector device 1 and defines an opening 50. The opening 50 is preferably centered over the central orifice 60. The lip 54 is a flat protrusion that is in contact with the shelf 58 of the stopper 17 along substantially its entire length. The presence of the lip 54 maintains the stopper 17 in the proper position within the neck 40 of the first container 18. The lip 54 can be connected to the connector device 12 by any conventional method, such as molding the lip 54 as an integral part of the connector device 12.

A cap 66 may be located atop the guide 14 of the connector device 12 to seal the interior of the guide and further seal the first ingredient 20 in the first container 18 in the unlikely event that the perforable membrane 64 ruptures. The cap 66 can be any cap attachable to the guide 14 of the connector device 12, such as a conventional plastic cap. The cap 66 is preferably attached to the guide 14 by a conventional method, such as threads or a frictional fit, to prevent the cap 66 from dislodging during shipment.

Figure 7:
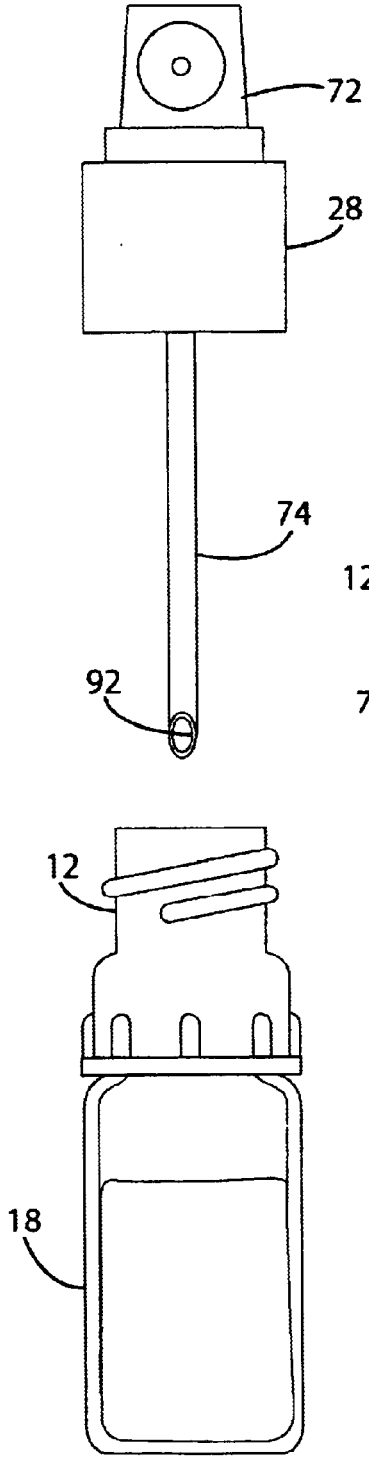
FIG. 7 is a side elevational view of the pump, vial and connector device according to a preferred embodiment.
Figure 8:
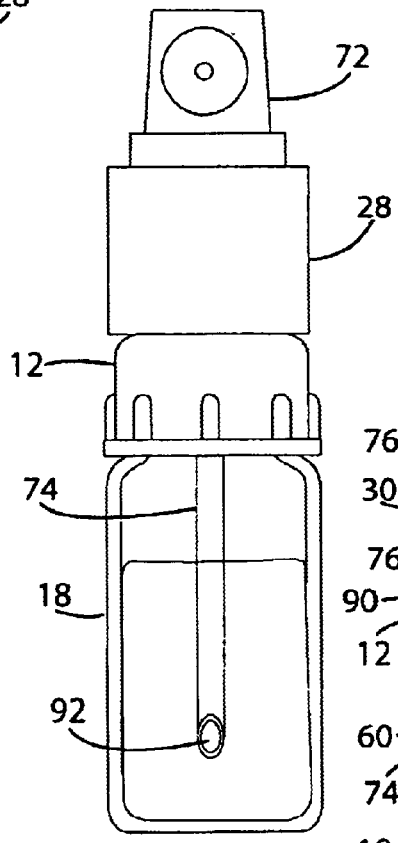
FIG. 8 is a side elevational view of a pump, vial and connector device assembly according to a preferred embodiment.
Figure 9:
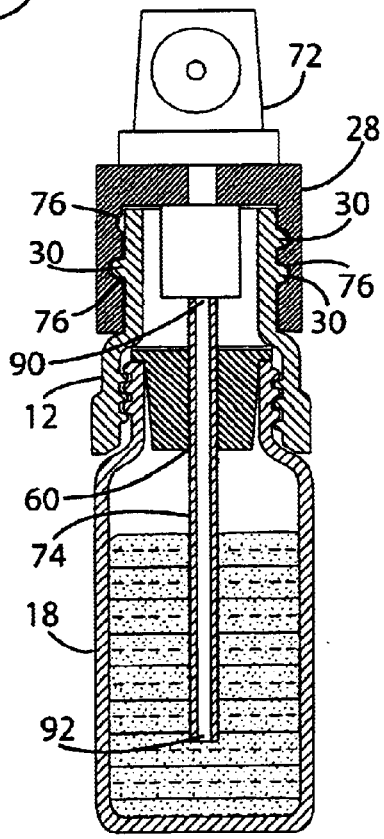
FIG. 9 is a cross-sectional view taken along line 3—3 of the pump, vial and connector device assembly.

FIGS. 7–9 show the interaction of the connector device 12 and dispenser 28. The dispenser 28 can be any dispenser device capable of dispensing a mixture from the first container 18. In the illustrated embodiment, the dispenser 28 is a generally conventional finger pump, as shown in the figures. While the invention will be described with reference to a conventional finger pump, it is to be understood that the dispenser 28 can be any structure capable of dispensing solution from the first container 8, such as a spout or dropper.

The finger pump 28 of the illustrated embodiment is a generally conventional finger pump having a pump 72, a tank 74 and pump connectors 76. The pump connectors 76 can be any connection device capable of interconnecting with the connector device 12 and the dispenser 28. The tank 74 is hollow and has an open first end 90 and an open second end 92. The first end 90 of the tank 74 is connected to the pump 72. The second end 92 of the tank 74 preferably includes a sharp point to facilitate insertion of the dispenser 28 into the stopper 17 through the perforable membrane 64. In the assembled position, as shown in FIGS. 8 and 9, the second end 92 of the tank 74 of the dispenser 28 contacts the solution contained in the first container 18. The dimensions of the tank 74 preferably closely match the dimensions of the central orifice 60 so that a seal is created between the central orifice 60 and the tank 74 when the dispenser 28 is attached to the first container 18. This seal prevents the solution from escaping the first container 18 during use and storage.

To assemble a connector device and vial according to this invention, a stopper 17 is inserted into the neck 40 of a first container 18. A perforable membrane 64 is placed over the stopper 17 so that the perforable membrane 64 covers the central orifice 60 of the stopper 17. The connector device 12 is placed atop the first container 18 and the container connectors 44 are interconnected with the rim connectors 56. The manner of connecting the container connectors 44 and rim connectors 56 will vary depending on the types of connectors used. In a preferred embodiment both the container connectors 44 and rim connectors 56 consist of threads, and the connector device 12 is twisted onto the first container 18 until the container connectors 44 interlock with the rim connectors 56. Upon connection of the container connectors 44 to the rim connectors 56, the perforable membrane 64 is clamped between the stopper 17 and the lip 54 of the connector device 12, as is perhaps best shown in FIG. 3.

Method of Use

To use the connector device of the present invention, the cap 66 is removed from the connector device 12 to open the guide 14 and reveal the perforable membrane 64. The injection device 26 of the second container 22 is then inserted into the central orifice 60 of the stopper 17. The opening 50 defined by the lip 54 shepherds the injection device 26 into an appropriate position to enter the central orifice 60 of the stopper 17. Additionally, the guide 14 closely receives the barrel 68 of syringe 22 to shepherd the syringe 22 into place and provide a more stable, positive interaction between the syringe 22 and the connector device 12.

When inserted into the connector device 12, the injection device 26 of the second container 22 pierces the perforable membrane 64 and enters the central orifice 60. In a preferred embodiment, the injection device 26 pierces the perforable membrane 64 so that the central orifice 60 is only partially exposed. The unadulterated portion of the perforable membrane 64 reduces the likelihood of dust and other matter entering the first container 18.

The second ingredient 24 is then dispensed into the first container 18. If a plunger 70 is used, the plunger 70 is movable from a retracted position to an inserted position. As the plunger 70 is moved from the retracted position to the inserted position, the second ingredient 24 is expelled from the barrel 68 through injection device 26. When the plunger 70 is fully inserted into the barrel 68, the second ingredient 24 preferably is completely expelled from the barrel 68. The first container 18 is preferably shaken to mix the first ingredient 20 and second ingredient 24 while the first container 18 and second container 22 are still connected. Optionally, the ingredients can be mixed after connecting the dispenser 28 to the first container 18.

After expelling the second ingredient 24 from the second container 22 and, if desired, mixing the ingredients, the second container 22 is removed from the first container 18. The dispenser 28 is then attached to the first container 18. Again, the unadulterated portion of the perforable membrane 64 reduce the likelihood of dust and other matter entering the first container 18 after the second container 22 is removed and before the dispenser 28 is attached. As discussed previously, the manner of connecting the dispenser 28 to the first container 18 will vary depending on the types of connectors used. In a preferred embodiment, the external connectors 30 and pump connectors 76 are threads, and the dispenser 28 is twisted onto the first container 18 until the external connectors 30 interlock with the pump connectors 76.

When inserted into the connector device 12, the second end 92 of the tank 74 pierces the perforable membrane 64 and the tank 74 enters the central orifice 60. As the tank 74 is inserted into the central orifice 60, the tank 74 preferably penetrates the perforable membrane 64 sufficiently to reveal the entire central orifice 60. The central orifice 60 closely interfits with the tank 74 to tightly seal the first container 8, therefore the dimensions of the central orifice 60 will vary according to the dimensions of the tank 74. The dispenser 28 is used to dispense the mixed solution from the first container 18. If the dispenser 28 consists of a pump; the pump 72 is repeatedly depressed to dispense the product.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The embodiments of the invention in which an exclusive property or privilege is claimed are defined as follows:

1. A kit for intermixing ingredients comprising:

a first container containing a first ingredient;

a second container containing a second ingredient;

a dispenser for dispensing a mixture of said first ingredient and said second ingredient from said first container; and a connector device connected to said first container, said connector device having a guide for aligning said first container with said second container in a position to allow said second ingredient to be discharged into said first container, said connector device further including a connector for connecting said dispenser to said connector device while said connector device is connected to said first container, said connector device positioning said dispenser in an appropriate position to dispense said mixture from said first container without returning said mixture to said second container.

2. The kit of claim 1, wherein said first container includes a neck portion and further including a perforable membrane closing said neck portion.

3. The kit of claim 2, wherein said connector device has a guide to shepherd said second container into an appropriate position with respect to said perforable membrane to allow said second ingredient to puncture said perforable membrane to discharge said second ingredient into said first container.

4. The kit of claim 3, further including a stopper having a top surface inserted into the neck of said first container, said second container being capable of penetrating said stopper, wherein said perforable membrane covers at least a portion of said top surface.

5. The kit of claim 4, wherein said stopper has a height and further includes a central orifice extending through said height.

6. The kit of claim 5, wherein said perforable membrane covers said central orifice.

7. A kit for intermixing ingredients comprising:

a first container containing a first ingredient, a perforable membrane, a neck portion, and a stopper inserted into the neck portion, said stopper having a top surface, a height, and a central orifice extending through said height, said perforable membrane covering said orifice and at least a portion of said top surface, closing said neck portion;

a second container containing a second ingredient;

a dispenser for dispensing a mixture of said first ingredient and said second ingredient from said first container, said dispenser comprising a finger pump having a tank; and a connector device connected to said first container, said connector device including a guide for aligning said first container with said second container in a position with respect to said perforable membrane to allow said second ingredient to puncture said perforable membrane and be discharged into said first container, said connector device further including a connector for connecting said dispenser to said connector device while said connector device is connected to said first container, said connector device positioning said dispenser in an appropriate position to dispense said mixture from said first container, said tank tightly fitting within said central orifice when said dispenser is attached to said first container.

8. The kit of claim 7, wherein said perforable membrane is clamped in position between said connector device and said stopper.

9. The kit of claim 3, wherein said second container is a syringe having a barrel, said guide being dimensioned to closely receive said barrel.

10. A kit for intermixing ingredients comprising:

a first container including a neck portion having a stopper with a top surface within said neck portion and a perforable membrane covering at least a portion of said top surface of said stopper, said first container containing a first ingredient to be mixed;

a second container containing a second ingredient to be mixed with said first ingredient to provide a mixture;

a dispenser for dispensing said mixture from said first container, said dispenser being distinct from said second container; and a connector device connected to said first container, said connector device having a guide to shepherd said second container into an appropriate position with respect to said perforable membrane to allow said second ingredient to be discharged into said first container, said connector device further including a connector for connecting said dispenser to said connector device while said connector device is connected to said first container, said connector device positioning said dispenser in an appropriate position to dispense said mixture from said first container.

11. The kit of claim 10, wherein said stopper has a height and includes a central orifice through said height, said central orifice being covered by said perforable membrane.

12. A kit for intermixing ingredients comprising:

a first container including a neck portion having a stopper with a top surface within said neck portion, a height, a central orifice through said height and a perforable membrane covering said central orifice and at least a portion of said top surface of said stopper, said first container containing a first ingredient to be mixed;

a second container containing a second ingredient to be mixed with said first ingredient to provide a mixture;

a dispenser for dispensing said mixture from said first container wherein said dispenser is a finger pump; and a connector device connected to said first container said connector device having a guide to shepherd said second container into an appropriate position with respect to said perforable membrane to allow said second ingredient to be discharged into said first container, said connector device further including a connector for connecting said dispenser to said connector device while said connector device is connected to said first container, said connector device positioning said dispenser in an appropriate position to dispense said mixture from said first container.

13. The kit of claim 12, wherein said finger pump includes a tank, said tank fitting tightly within said central orifice when said dispenser is connected to said first container.

14. The kit of claim 13, wherein said tank has a pointed tip to facilitate penetration of the perforable membrane.

15. The kit of claim 14, wherein said second container is a syringe.

16. The kit of claim 15, wherein said perforable membrane is clamped between said connector device and said stopper.

17. The kit of claim 10, wherein said second container is a syringe having a barrel, said guide being dimensioned to closely receive said barrel.

18. A method of intermixing products including the steps of:

(a) connecting a connector device to a first container, the first container containing a first ingredient and the connector device including a guide;

(b) inserting a second container into the guide of the connector device, the second container containing a second ingredient, the connector device shepherding a dispensing means of the second container into a position for directly dispensing the second ingredient into the first container;

(c) dispensing the second ingredient from the second container into the first container;

(d) mixing the second ingredient and the first ingredient in the first container to form a mixture;

(e) removing the second container from the connector device; and (f) connecting a dispenser to the connector device, the connector device positioning the dispenser into a position to allow the mixture to be dispensed from the first container without returning the mixture to the second container.

19. The method of claim 18, wherein the first container further includes a perforable membrane, said perforable membrane being penetrated when said dispensing means of said second container is positioned to dispense said second ingredient into said first container, and when said dispenser is positioned to dispense the mixture from the first container.

20. The method of claim 19, further including the step of fitting a stopper into the connector device.

* * * * *